United States Patent [19]

Jones

[11] Patent Number: 4,512,107

[45] Date of Patent: Apr. 23, 1985

[54] AUTOMATED POLISHER FOR CYLINDRICAL SURFACES

[75] Inventor: Robert A. Jones, Ridgefield, Conn.

[73] Assignee: The Perkin-Elmer Corporation, Norwalk, Conn.

[21] Appl. No.: 441,987

[22] Filed: Nov. 16, 1982

[51] Int. Cl.[3] ..... B24B 5/40

[52] U.S. Cl. ..... 51/56 R; 51/165.93; 51/165.71

[58] Field of Search ..... 51/56 R, 281 P, 284 R, 51/290, 31, 261, 34 C, 48 R, 50 R, 54, 67, 71, 165.71, 165.93

[56] References Cited

U.S. PATENT DOCUMENTS

| | | | |
|---|---|---|---|
| 1,281,001 | 10/1918 | Hazel | 51/56 |
| 2,059,723 | 11/1936 | Briney | 51/48 R |
| 3,589,078 | 6/1971 | Bala | 51/54 |
| 3,676,960 | 7/1972 | Aspden | 51/54 |
| 4,128,968 | 12/1978 | Jones | 51/165.71 |
| 4,229,908 | 10/1980 | Panzeri | 51/165.93 |

*Primary Examiner*—Frederick R. Schmidt
*Assistant Examiner*—Robert A. Rose
*Attorney, Agent, or Firm*—Thomas P. Murphy; Edwin T. Grimes

[57] ABSTRACT

An automated polisher for cylindrical surfaces. A cylindrical workpiece is rotated about its longitudinal axis. A pad is urged against the inside of the workpiece as it is turned. The pad is quickly moved in a small circle or ellipse or in a short reciprocating motion. The pad is also moved longitudinally along the length of the workpiece so the center of quick pad movement traces a helix on the inner surface of the workpiece. The speed of movement of the center of quick pad movement is controlled as a function of the position of the pad relative to the workpiece so that a controlled polishing occurs.

8 Claims, 7 Drawing Figures

AUTOMATED POLISHER FOR CYLINDRICAL SURFACES

BACKGROUND OF THE INVENTION

The present invention relates to an apparatus for polishing or grinding optical surfaces and particularly to a device for either grinding or polishing cylindrical mirrors of the type used in, for example, X-ray telescopes.

Cylindrical grinding or polishing heretofore involved devices for turning the cylindrical workpiece about its longitudinal axis. As the work piece is turned, a pad, usually mounted on an arm, is positioned so it is in contact with the inner surface of the cylindrical workpiece. A slurry on the surface acts to either grind or polish the surface as the workpiece is turned.

The polisher described above is operated so that the pad is urged against a portion of the inner surface of the cylindrical workpiece. As the workpiece is rotated about its longitudinal axis, the portion of the surface contacted by the pad is either polished or ground depending on the slurry being used at the time. After a period of time, the pad is positioned to contact another area of the cylindrical surface. Operating the roller polisher in this manner, however, produces ridges on the cylindrical surface caused by either the overlapping or the failure to overlap areas being polished or ground when the pad position is changed from one position to the next. To overcome the problem of the ridges produced by operating the polisher in the above-described manner, the pad can be continually reciprocated in a direction parallel to the cylindrical workpiece axis. This approach, while largely eliminating the problem of creating ridges on the cylindrical surface, does not readily lend itself to precise grinding and polishing of the surface.

OBJECTS OF THE INVENTION

In view of the above-mentioned problems relating to cylindrical grinding or polishing, it is the principal objective of the invention to provide a cylindrical workpiece polisher/grinder which can be precisely controlled to produce a cylindrical surface having a predefined shape to within a very small margin of error.

It is a further objective of the invention to provide a cylindrical surface polisher/grinder which is controllable by suitable control means to polish/grind the workpiece in selected regions to produce a cylindrical surface having a predefined shape to within a small margin of error.

BRIEF DESCRIPTION

The present cylindrical polisher/grinder imparts three motions to the polishing pad, two of which are used primarily to position the pad while the third motion primarily controls the rate of surface removal. A generally rectangular-shaped pad having a length of not greater than $\frac{1}{4}$ the workpiece length is positioned in contact with the surface being polished/ground. The pad is rotated about a center point in either a circular or elliptical path at a relatively rapid rate of up to about 165 orbits per minute. This pad movement controls the rate of surface removal.

The position of the center of rotation of the pad is moved in two ways relative to the cylindrical surface being polished or ground. Firstly, the center of pad rotation is gradually reciprocated in a direction parallel to the longitudinal axis of the cylinder. At the same time, the cylindrical workpiece is rotated about its longitudinal axis. Accordingly, the center of pad rotation traces a cylindrical or conical helix on the inner cylindrical surface of the workpiece. The rate of speed assigned to the reciprocating motion and the rate at which the cylinder is turned about its longtudinal axis is controlled by a speed controller computer according to a predefined set of parameters.

BRIEF DESCRIPTION OF THE DRAWINGS

The above-mentioned objects, advantages, and features are described below in greater detail in connection with the drawings which form a part of the disclosure wherein.

DETAILED DESCRIPTION

Figure 1:
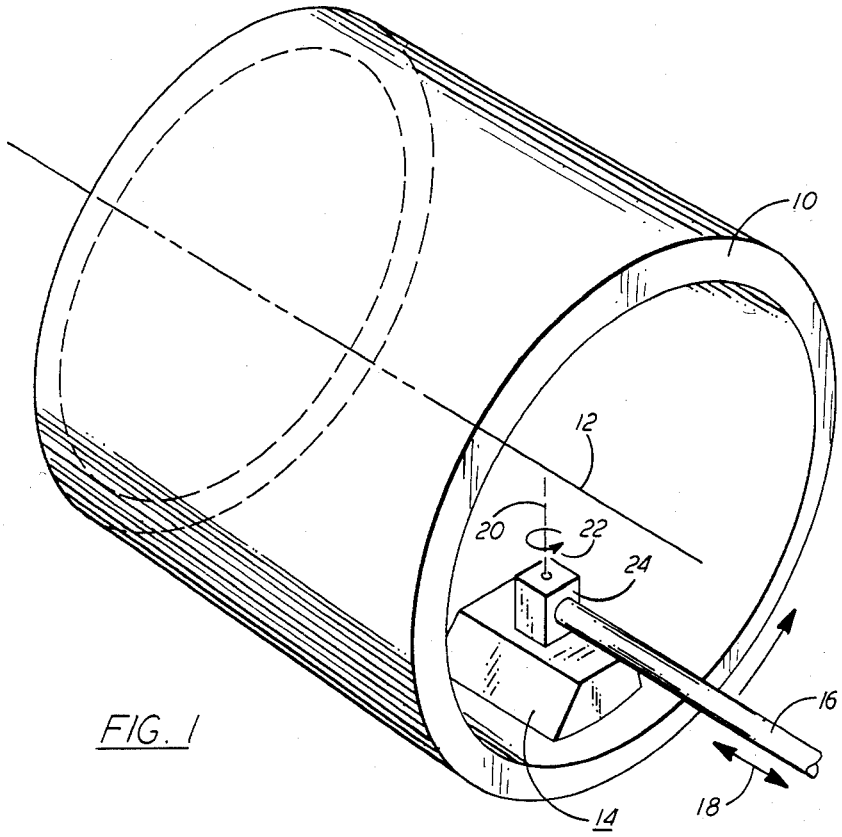
FIG. 1 illustrates a typical workpiece and the movement of the pad relative to the workpiece.

Referring first to FIG. 1, a cylindrical workpiece 10 is illustrated with an axis of rotation 12 disposed in a horizontal plane. The workpiece 10 is typically made of optical glass or other suitable material which permits the inner surface of the cylindrical workpiece 10 to be either ground or polished so as to provide the desired surface shape onto which a reflective material is later deposited. Once the desired shape and reflective layer have been produced, the workpiece 10 may be utilized in, for example, X-ray telescopes or other optical arrangements. In such applications, the inner surface of the workpiece 10 will have a circular shape for each planar slice taken through the workpiece in a direction perpendicular to the rotation axis 12. However, the diameter of each circular slice will vary depending on the longitudinal position of the slice itself. Accordingly, the shape of the inner surface of the workpiece 10 in a direction parallel to the axis of rotation 12 may in fact be parabolic or any other desired shape, be it curved or a straight line.

In typical optical grinding and polishing operations, a workpiece, such as that illustrated at 10, is fabricated in a shape approximating that of the desired finished product. Since the manufacturing process is not as precise as it needs to be in order for the finished product to be used in an optical system, the inner surface must thereafter be ground and polished until the desired precise shape of the inner surface is obtained. The apparatus according to the present invention is designed specifically for grinding and polishing the inner surface of a cylindrical workpiece so that it will have a desired shape.

In the apparatus according to the present invention, a workpiece 10 is typically mounted so that its rotation axis 12 is disposed horizontally and the workpiece 10 is caused to turn about its rotation axis 12. This rotary movement of the workpiece is one of three movements of the workpiece 10 relative to a pad 14 which is urged against the inner surface of the workpiece 10. The pad is made of conventional material which, during either grinding or polishing, will conform to the shape of the inner surface of the workpiece 10 as it is moved relative to the workpiece. In grinding, a ceramic pad 14 may be used while during polishing, a pitch pad is most frequently used.

The pad 14 is mounted on a movable arm 16. The movable arm 16 is designed to move in a slowly reciprocating manner causing the pad 14 to be moved back and forth in a direction indicated gernally by the doubleheaded arrow 18. This allows the pad 14 to come into contact with the entire inner surface of the workpiece 10 as the pad traverses from one end of the cylindrical workpiece 10 to the other as the workpiece 10 is itself revolved about its axis of rotation 12. Accordingly, the contact point between the center of the pad 14 and the inner surface of the workpiece 10 traces a helix on the inner surface of the workpiece 10. In addition to the two motions already described for movement of the pad 14 relative to the workpiece 10, the pad 14 is also rotated about the vertical axis indicated by the dotted line 20 which passes through the center of the pad support member 24 which is disposed at the extreme end of the arm 16. The motion of the pad 14 relative to the axis 20 is illustrated by the arrow 22. The mechanism for causing the pad 14 to revolve about the axis 12 is adjustable so that the path defined by the arrow 22 can be circular or elliptical.

Figure 2:
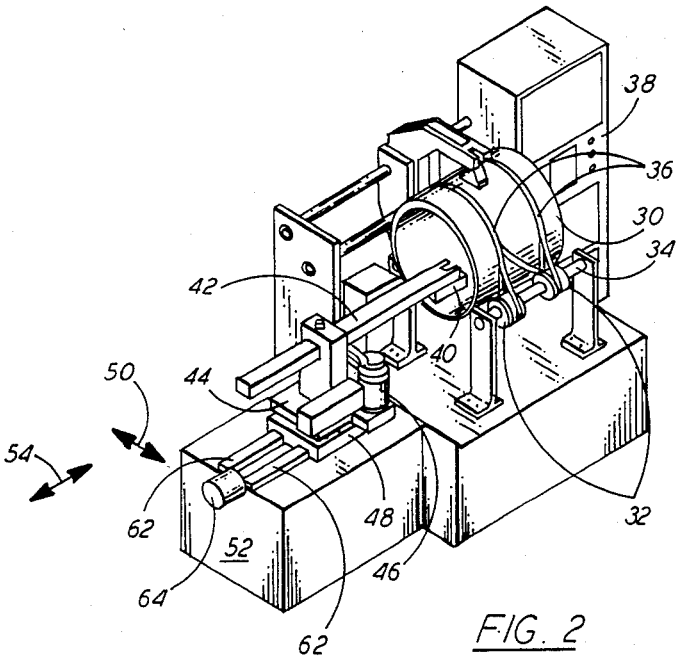
FIG. 2 illustrates a cylindrical polisher of the type characterized by the present invention.

FIG. 2 is an illustration of a cylindrical workpiece grinder/polisher according to the present invention. The workpiece 30 is mounted so its longitudinal axis is disposed horizontally, and the external surface of the workpiece 30 rides on rollers 32 which are mounted for rotation on a horizontally disposed axle 34. A similar pair of rollers and axle are hidden from view but are located behind the workpiece 30 as viewed in FIG. 2. A pair of drive bands 36 pass over rollers mounted on the axle 34 as well as a similar pair of rollers located on the axle hidden from view. The axle hidden from view is driven by a motor, also hidden from view, thereby causing the drive bands 36 to turn the workpiece 30. The speed of rotation of the workpiece 30 is defined by a system control computer 38, which is coupled to the drive motor (not shown) which turns the axle hidden from view. The speed of rotation is set in accordance with a table stored in the memory of computer 38 identifying the desired speed of rotation as a function of the position of the pad 40 relative to the workpiece 30.

The pad 40 is mounted on the extreme end of an arm which projects into the workpiece 30. The arm 42 is mounted at its opposite end to a first intermediate support base 44 which is movably mounted on a second intermediate support base 48. An adjustable speed motor 46 is secured to a support member 52 and coupled to the first intermediate support base 44 and the second intermediate base 48. When the motor 46 is operating, the first base 44 moves back and forth in the direction of arrow 50, as does the arm 42. The second intermediate base 48 is movably mounted on the base support member 52 so it can move back and forth in a direction parallel to the arm 42 by the motor 46.

In operation, the speed of the motor 46 is preset to a known value. By adjusting the length of the linkages between the motor 46 and the first intermediate base 44 and between the motor 46 and the support member 52, the arm 42 can be placed into motion so that the center of the pad 40 mounted on arm 42 will trace a circular or elliptical path on the workpiece surface. The computer 38 has sensors (not shown) which sense to the arm 42 position relative to the workpiece 30. As already mentioned, the speed of rotation of the workpiece 30 is controlled by the computer 38. In addition, the computer 38 responds to the sensors (not shown) to control the speed of movement of the arm 42 in the direction of arrow 54. This movement is provided by a second motor 64 mounted on the base support member 52. The motor 64 is coupled via a lead screw or the like to the second intermediate base 48 to cause the base 48 to move in the direction of the doubleheaded arrow 54.

Figure 3:
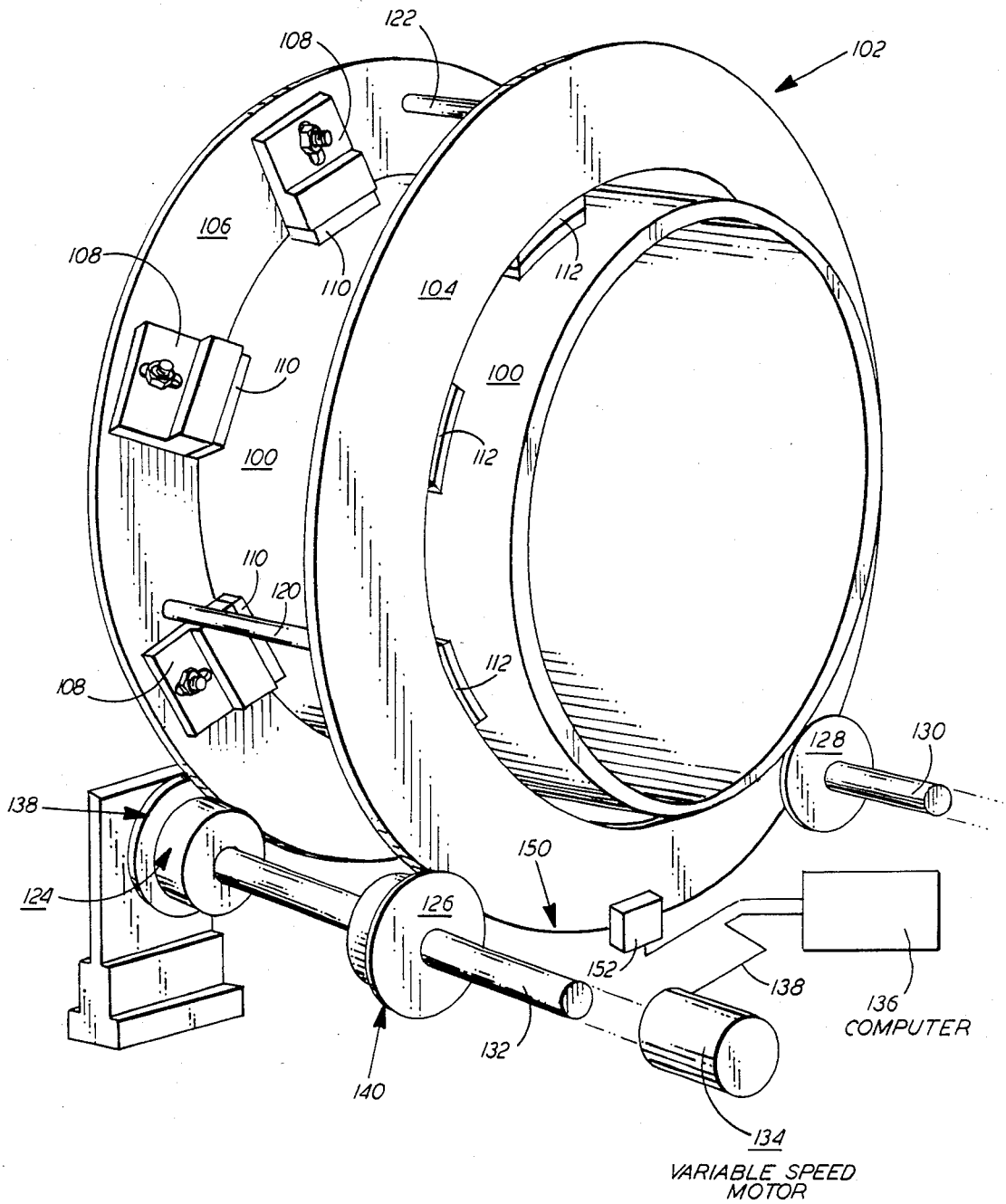
FIG. 3 illustrates the preferred manner for supporting and turning the cylindrical workpiece and the apparatus for detecting the rotary position of the workpiece.

The preferred manner of mounting and rotating a cylindrical workpiece in accordance with the present invention is illustrated in FIG. 3. In this arrangement, a cylindrical workpiece 100 is mounted in a workpiece holder 102 which includes two ring members 104 and 106 which encircle the workpiece 100. A plurality of workpiece engaging members 108 are adjustably mounted to the ring member 106 so that the workpiece engaging portion 110 is in contact with the outer surface of the workpiece 100. The engaging members 108 are adjusted in position so that the rotation axis of the workpiece 100 is coextensive with the axis of rotation of the ring member 106.

A plurality of workpiece engaging members 112 are adjustably mounted on the ring member 104 in the same manner as the engaging members 108 are mounted on the ring 106. The position of the engaging members 112 are adjusted so that the axis of rotation of the workpiece 100 is coextensive with the axis of rotation of the ring member 104.

The ring members 104 and 106 are held in parallel relationship to each other by a plurality of connecting rods, rods 120 and 122 being shown. These rods 120 and 122 serve to maintain the parallel relationship between the planes formed by the ring members 104 and 106.

The ring members 104 and 106 are disposed to rest on rollers 124, 126, 128 and a fourth roller, not shown, which, however, is mounted on the same shaft 130 as the roller 128. The rollers 124 and 126 are mounted on a shaft 132 which is coupled to a variable speed motor 134. This motor is coupled to a computer 136 which transmits information over the line 138 to the variable speed motor 134 to control the rotary speed of that motor 134. The rollers 124 and 126 respectively have lips 138 and 140 which extend outwardly from the surface of the roller on which the ring members 104 and 106 rest. The lip 138 as viewed in FIG. 3 is disposed to the left of the ring member 106, while the lip 140 of roller 126 is located to the right of ring member 104. Accordingly, as the shaft 132 is rotated by the motor 134, the two ring members 104 and 106 which rest on the rollers 124 and 126 begins to turn. The lips 138 and 140 prevent the ring members 104 and 106 from falling off the rollers 124 and 126.

As already indicated, the speed of rotation as controlled by the motor 134 will vary as a function of the position of the pad relative to the workpiece 100. Accordingly, some manner must be provided to measure the rotary position of the workpiece 100. As illustrated in FIG. 3, a plurality of position markings 150 may be located on the ring 104. The position markings 150, for convenience, have been shown only along a portion of the ring 104; however, it will be understood that these markings 150 extend entirely around the ring 104. The markings on the ring 104 can be detected by an optical detector 152, which is coupled to the computer 136. The computer 136 can then utilize the information from the optical detector 152 to determine the exact rotary position of the workpiece 100 with respect to any fixed reference point not located on the rotating assembly including the ring members 104 and 106. Once the position of the workpiece 100 relative to a fixed position in space is known, the computer 136 can use that positional information as one input to its table which specifies prior to running of the system the speed at which the workpiece 100 is to be rotated. The second input to the table, as previously indicated, is the position of the pad supporting arm relative to the workpiece 100.

Those of skill in the art will readily recognize that the position markings 150 and the sensor 152 could take on various forms while still providing the overall desired function of being able to detect the position of the workpiece 100 with respect to a fixed point in space. It will also be recognized that the positon markings 150 could be placed on the outside surface of the workpiece 100 and a sensor placed near those markings so as to detect the position of the workpiece 100. This latter approach has the advantage of having the position markings on the workpiece itself so that, if necessary, the workpiece can be removed from the ring members 104 and 106 if need be in order to make measurements on the inner surface. From these measurements, the deviation between the desired contour and actual contour is calculated and thereafter used in determining the dwell time of the pad over particular areas of the workpiece during subsequent grinding or polishing.

Figure 4:
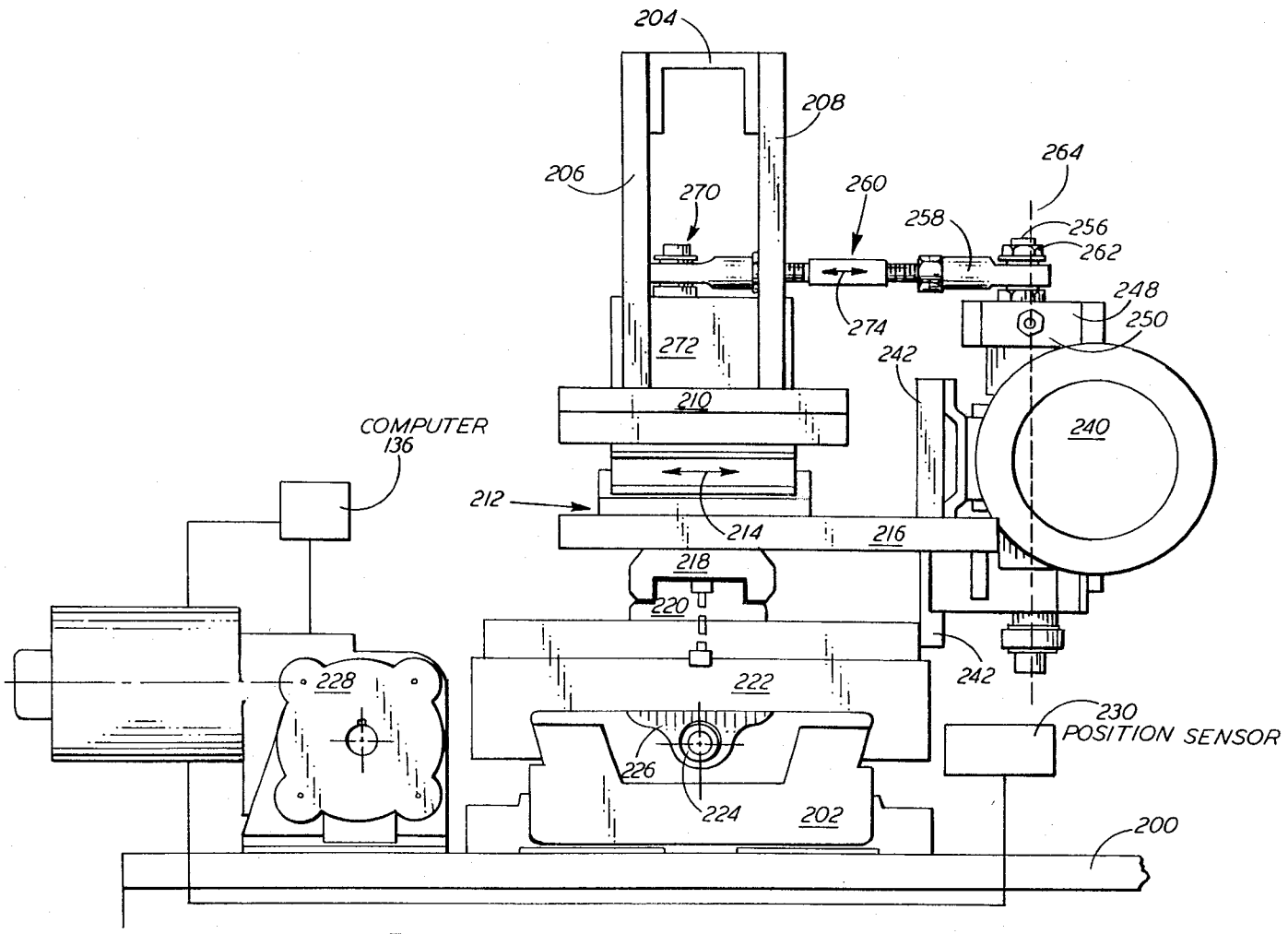
FIG. 4 illustrates an end view of the mechanism for moving the pad either in an elliptical path or a circular path.

Referring now to FIG. 4, the preferred mechanism for moving the pad in either a circular or elliptical path is illustrated. As will be recognized by those of skill in the art, the apparatus for placing the pad into movement along a circular or elliptical path may be located at the end of the arm closest to the pad or, as is the case in the preferred embodiment of the present invention, the arm itself may be moved in a circular or elliptical motion thereby causing the pad to follow a similar path. The apparatus of FIG. 4 includes a support member 200 such as a bench or the like, on which all of the apparatus is located. Coupled to the support member 200 is a track member 202, shown in cross section, which extends perpendicularly to the sheet of FIG. 4. The track member 202 provides a fixed reference relative to which the arm 204 is moved in a plane substantially parallel to the support member 200. The arm 204 itself is attached by two vertically oriented support members, 206 and 208, which are secured at their lowermost end to a first intermediate base member 210. The base member 210 is slidably mounted on at least one rail 212 thereby permitting movement of the base member 210 in the plane of the sheet of FIG. 4 in the directions indicated by the doubleheaded arrow 214.

The rails 212 are mounted on a second intermediate support member 216 which itself is secured to a slidable member 218 that slides on a track 220 which is shown in cross section, thereby allowing the slidable member 218 to slide on the track 220 in a direction perpendicular to the sheet of FIG. 4. Accordingly, the arm 204 can be moved relative to the track 220 in a direction indicated by the doubleheaded arrow 214 as well as in the perpendicular direction to the sheet of FIG. 4. By causing the motion in these two directions to be oscillatory, the path followed by the arm 204 can be made to be circular, elliptical, or in some instances, a back and forth stroking either in the direction of the doubleheaded arrow 214 or perpendicular to the sheet of FIG. 4.

The track 220 is secured to a movable support base 222 which is movable in a direction perpendicular to the sheet of FIG. 4 along the track 202. The movable support base 222 is moved along the track 202 under power provided by a rotating lead screw 224 which is threaded through a lead screw follower member 226 that is rigidly attached to the underside of the movable support base 222. As the shaft 224 is rotated, the support base 222 is moved in a direction perpendicular to the sheet of FIG. 4 at a rate which is a function of the rotary speed of the lead screw 224 as well as the number of turns per inch on the threaded lead screw 224.

The shaft 224 is easily rotated by directly coupling it to a motor or, as is the case in the preferred embodiment of the present invention, the shaft 224 is coupled to a motor 228 by a conventional pulley and belt arrangement (not shown). In the preferred embodiment, the motor 228 is coupled to the system computer 136, which controls the speed of the motor 228 as a function of the position of the support base 222 relative to the track 202. The positional information is made available to the computer 136 via a position sensor 230, which is disposed adjacent the movable support base 222 and which can sense the position markings 232 located on the movable base 222 as seen in FIG. 5.

The position of the base 222 can also be determined precisely relative to the track 202 by numerous other approaches. For example, a shaft encoder having a plurality of markings thereon similar to those at 150 in FIG. 3 can be mounted on the shaft 224. Then, a sensor such as 230 could be positioned adjacent that shaft encoder for sensing the markings thereon. The position of the shaft 224 would then be transmitted to the computer 136.

The arm 204 is placed into either rotary, elliptical or linear reciprocating motion by a motor 240, which is secured to a vertically disposed support member 242, which is attached at its lowermost end to the movable support base 222. The motor 240 has a generally horizontally disposed drive shaft which couples to a universal joint 244 thereby producing rotary motion to a vertically disposed drive shaft 246. A slotted drive member 248 is mounted on the upper portion of the shaft 246 and secured thereto by one or more screws 250. Riding in the slot 252 is the head of a nut or the like 254 having a vertically disposed threaded shaft 256. One end 258 of a turnbuckle indicated generally at 260 extends over the shaft 256 and is secured thereto by a nut 262. As viewed in FIG. 4, the axis of the threaded shaft 256 is displaced from the axis of rotation 264 for the drive shaft 246. The extent of displacement between the axis of the shaft 256 and the rotation axis 264 is controlled by the adjustment of the turnbuckle 260. Once the desired offset between the shaft 256 and the axis 264 is established by adjusting the turnbuckle, the nut 262 is tightened down. At the opposite end of the turnbuckle 260 from the nut 262 is another nut and bolt arrangement indicated generally at 270 which secures the turnbuckle 260 to a block 272 which is affixed to the first intermediate base member 210. As a result of this arrangement, when the drive shaft 246 is turned about the axis 264, the rotary motion is converted by the coupling of the shaft 256 to the slotted drive member 248 to a reciprocating motion of the turnbuckle in a direction indicated generally by the arrow 274. This reciprocating motion of the turnbuckle causes the first intermediate base member 210 and all system elements attached thereto to reciprocate back and forth in a direction indicated by the doubleheaded arrow 214.

Figure 5:
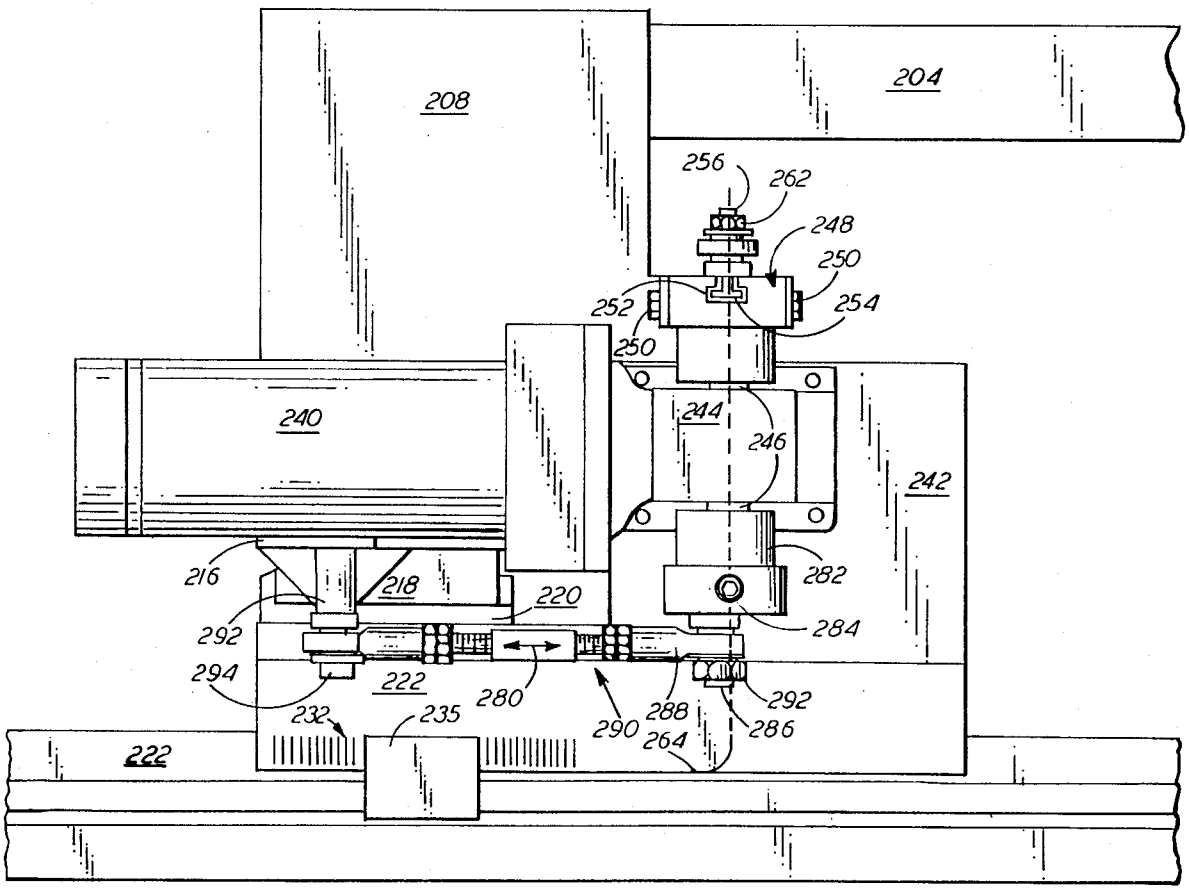
FIG. 5 is a side view of the apparatus in FIG. 4.

A similar arrangement is illustrated in FIG. 5 for reciprocating the intermediate support member 216 in a direction indicated by the doubleheaded arrow 280. This is accomplished by having a slotted drive member 282 affixed to the lower portion of the drive shaft 246 by one or more screws 284. A threaded bolt or the like is mounted in the slot (not shown) in member 284 having its threaded shaft 286 extend downwardly therefrom. The end 288 of a turnbuckle 290 extends over the shaft 286 and is secured thereto by a nut 292. The turnbuckle 290 is adjusted so that the axis of the shaft 286 is displaced away from the rotation axis 264 of the drive shaft 246. With this manner, mechanism, rotary motion of the shaft 246 is converted into reciprocating motion of the turnbuckle 290 in a direction indicated by the doubleheaded arrow 280. The leftmost end of the turnbuckle 280 is affixed to a shaft 292 by a nut 294. The shaft 292 is affixed to the intermediate support member 216 so that rotary motion of the member 284 is converted into reciprocal motion, in the direction of doubleheaded arrow 280, of the intermediate support member 216. Since the reciprocating motions created by the mechanism illustrated in FIGS. 4 and 5 are perpendicular to each other, the arm 204 is placed into a circular or elliptical path in a plane perpendicular to the sheet of FIG. 4. The exact shape of the ellipse or circle is controlled by the extent of offset between the shaft 256 and 286 from the rotation axis 264. In the event this offset is identical, the motion imparted to the arm 204 is circular. In the instance where there is offset for one of the shafts 256 or 286 but not for the other, linear reciprocating motion ensues.

The mechanism of FIGS. 4 and 5 is disposed on the support base 222 so that the center of motion for the base member 210 can be moved back and forth in the direction of the doubleheaded arrow 280. The base 222 is moved back and forth on the track 202.

Figure 6:
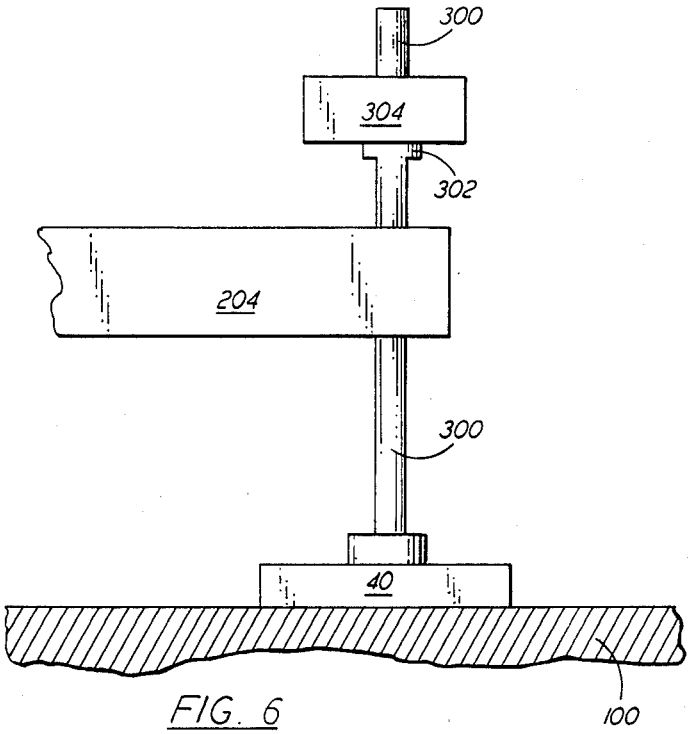
FIG. 6 illustrates the manner in which the pad is urged against the surface being ground or polished.

Referring now to FIG. 6, the extreme end of the arm 204 is illustrated at a position where it projects into the cylindrical workpiece 100. An elongated pad 40 having a length of not more than $\frac{1}{4}$ the length of the workpiece is disposed on the lowermost end of a support rod 300 which extends vertically from the pad 40, through the arm 204 and extends vertically above the arm. A flange 302 or the like is provided near the uppermost end of the support rod 300. One or more doughnut-shaped weights 304 can be placed over the support rod 300 and are supported by the flange 302. The number and the total weight of those weights added onto the support rod 300 depend entirely on the desired pressure between the pad 40 and the workpiece 100.

The support rod 300 is held in place by a ball bearing sleeve or the like (not shown) mounted in the arm 204 which permits very low friction in the vertical direction thereby allowing the weights 304 and the support shaft 300 to be the prime contributors to the force of the pad 40 against the workpiece 100. When the arm 204 is moved in a circular, elliptical or stroking motion in a plane perpendicular to the plane of the sheet of FIG. 6, the bearing sleeve will transfer that motion to the support shaft 300 thereby causing the pad 40 to move along a path the same shape as and parallel to the path of motion of the arm 204.

Figure 7:
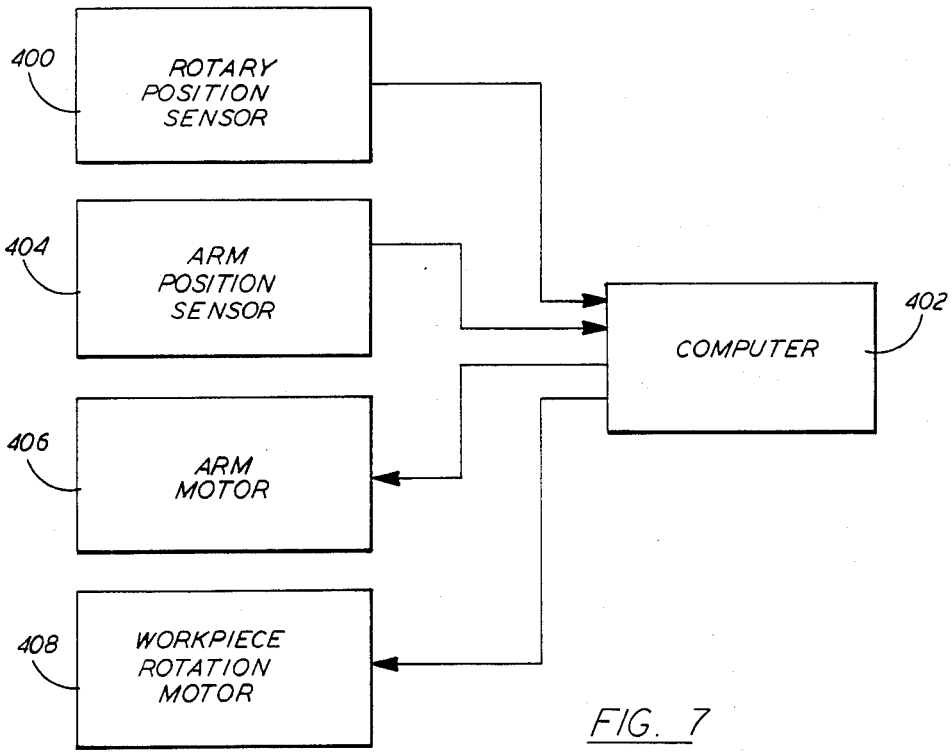
FIG. 7 illustrates the electrical controls for the grinder/polisher of the present invention.

Referring now to FIG. 7, the overall electrical controls for the system is illustrated. A rotary position sensor 400 is utilized to detect the rotary position of the cylindrical workpiece. The detector sends the indications of that rotary position to the system computer 402. An arm position sensor 404 is included to sense the position of the arm relative to the opposite ends of the cylindrical workpiece. This sensor 404 can respond to a circular coding wheel mounted on the drive screw used to move the platform on which the arm rests to thereby detect the position of the arm as it extends into the cylindrical workpiece. Alternatively, the sensor 404 can detect linear position markings on the arm carrying member itself to determine the position of the arm relative to the workpiece.

The positional information from the sensor 404 is also transmitted to the computer 402. The computer 402 utilizes the positional information from the sensor 400 and 404 to adjust the speed of movement of the arm relative to the surface of the workpiece being polished or ground. The positional information is used to access a two dimensional table in the computer memory which is established prior to the running of the polishing or grinding apparatus according to the invention. The two dimensional table indicates the speed desired for the motor 408 that turns the workpiece and the motor 406 that moves the arm as a function of the position of the center of pad movement relative to the workpiece.

When the pad carried by the arm reaches the end of its travel, which usually occurs when at least part of the pad extends over the end of the cylindrical workpiece, the motor 406 stops while the workpiece makes at least one revolution and then the motor 406 is operated in the reverse direction, thereby causing the arm to move in the direction opposite to that, which it had just previously been moving. The speed is again controlled by the table in the computer 402.

The motor which controls the speed of the circular, elliptical or reciprocating movement of the arm, in accordance with the present invention, is operated at a fixed speed throughout any one operation of the apparatus for either grinding or polishing. After the workpiece has been worked the required period of time as indicated by the computer 402, the workpiece is removed from the polisher/grinder and measurements are made thereon to determine the subsequent motor running speeds for further polishing or grinding operations. Once these are established the apparatus is again operated until it is time to again measure the workpiece.

The foregoing description has made particular emphasis upon the preferred embodiment of the present invention. However, those of skill in the art will readily recognize that numerous modifications may be made to the apparatus described herein without departing from the spirit and scope of the present invention as defined by the following claims.

What is claimed is:

1. An apparatus for either precision polishing or grinding the inner sutface of a cylindrical workpiece comprising, in combination:

means to support a cylindrical workpiece;

first drive means coupled to said support means to rotate said workpiece about its longitudinal axis at an adjustable speed;

an elongated arm with a free end, said arm being mounted for movement in a direction parallel to said longitudinal axis and disposed to project into the area surrounded by said workpiece;

a pad support means to urge a pad supported thereby against the inner surface of said workpiece, said pad support means being coupled to said free end of said arm;

means to move said pad in a repeating motion relative to said workpiece;

second drive means to move said arm relative to said workpiece at an adjustable speed;

first detector means to detect the position of said free end of said arm;

second detector means to detect the rotary position of said workpiece relative to said support means;

means responsive to said first detector means and said second detector means to adjust the speed of said first drive means and said second drive means in accordance with a predefined speed for said first and said second drive means as a function of the rotary position of said workpiece and the position of the free end of said arm.

2. The apparatus of claim 1 wherein said pad is elongated and has a length of not greater than 25% of the length of the workpiece.

3. The apparatus of claim 1 wherein said pad moving means is operative to move the center of said pad along an elliptical path.

4. The apparatus of claim 1 wherein said pad moving means is operative to move the center of said pad along a circular path.

5. The apparatus of claim 1 wherein said pad moving means is operative to move the center of said pad back and forth along a straight line.

6. The apparatus of claim 3 or 4 wherein said pad moving means moves said pad at a constant angular velocity.

7. The apparatus of claims 1, 3, 4 or 5 wherein said pad moving means is operative to move said arm and said pad is coupled to said arm substantially at its free end.

8. An apparatus for either grinding or polishing a cylindrical workpiece comprising in combination:

first support means to support a cylindrical workpiece;

first drive means coupled to said first support means to rotate said workpiece about its longitudinal axis at a settable speed;

an elongated arm with a free end disposed to project into the area surrounded by said workpiece, said arm being supported at the end opposite said free end by a second support means;

a third support means;

a fourth support means;

said second support means being mounted on a first track disposed on said third support means, said second support means being movable back and forth on said first track;

said third support means being mounted on a second track disposed in a direction generally perpendicular to the direction of said first track though in a different but parallel plane, said second track being mounted on said fourth support means;

second drive means coupled to said fourth support means to move said fourth support means at a settable speed in a selectable direction along a path substantially parallel to the axis of rotation of said workpiece;

third drive means to move said second support means back and forth on said first track and to move said third support means back and forth on said second track at an adjustable speed;

a pad;

means disposed substantially at said free end of said arm to urge said pad against the inner surface of said workpiece;

first position sensing means to sense the rotary position of the workpiece;

second position sensing means to sense the position of said arm relative to the open ends of the workpiece;

means responsive to said first sensing means and said second sensing means to continuously set the speed of said first drive means and said second drive means to a predefined speed determined as a function of the position sensed by said first sensing means and said second sensing means.

* * * * *